US011292141B2

(12) United States Patent
Wang

(10) Patent No.: US 11,292,141 B2
(45) **Date of Patent: *Apr. 5, 2022**

(54) POWER-ASSISTED FOLDING KNIFE

(71) Applicants: HANGZHOU GREAT STAR TOOLS CO., LTD., Hangzhou (CN); HANGZHOU GREAT STAR INDUSTRIAL CO., LTD., Hangzhou (CN)

(72) Inventor: Weiyi Wang, Hangzhou (CN)

(73) Assignees: Hangzhou Great Star Tools Co., Ltd., Zhejiang (CN); Hangzhou Great Star Industrial Co., Ltd., Zhejiang (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/728,502

(22) Filed: Dec. 27, 2019

(65) Prior Publication Data

US 2020/0130203 A1 Apr. 30, 2020

Related U.S. Application Data

(63) Continuation of application No. 15/544,398, filed as application No. PCT/CN2015/071002 on Jan. 19, 2015, now Pat. No. 10,583,571.

(51) Int. Cl.
*B26B 1/04* (2006.01)
*B26B 5/00* (2006.01)

(52) U.S. Cl.
CPC ..... *B26B 1/04* (2013.01); *B26B 1/044* (2013.01); *B26B 1/048* (2013.01); *B26B 5/00* (2013.01)

(58) Field of Classification Search
CPC ..... B26B 1/02; B26B 1/042; B26B 1/046; B26B 1/044; B26B 1/048; B26B 1/08
(Continued)

(56) References Cited

U.S. PATENT DOCUMENTS 4,040,181 A 8/1977 Johnson
4,281,458 A 8/1981 Okada
(Continued)

FOREIGN PATENT DOCUMENTS

CN 2506404 Y 8/2002
CN 1787896 A 6/2006
(Continued)

OTHER PUBLICATIONS

International Search Report dated Oct. 28, 2015 from corresponding International Application No. PCT/CN2015/071002, 6 pages.
(Continued)

*Primary Examiner* — Laura M Lee
(74) *Attorney, Agent, or Firm* — Blank Rome LLP

(57) ABSTRACT

A power-assisted folding knife, including: a blade holder; a blade arranged in the blade holder; a handle rotatably connected to the blade holder; a locking mechanism for locking the blade holder in an unfolded position and/or a folded position; the power-assisted folding knife further includes a power-assisting mechanism connected to the blade holder and the handle, for providing assisting power when unfolding a power-assisted folding knife. The power-assisted folding knife uses an assisting mechanism for providing assisting power when unfolding a folding knife, so as to facilitate easier unfolding of the folding knife and to allow single hand operation; the blade holder can be locked in an unfolded position and/or a folded position to ensure safe use of the power-assisted folding knife.

7 Claims, 8 Drawing Sheets

(58) Field of Classification Search
USPC ..... 30/159
See application file for complete search history.

(56) References Cited

U.S. PATENT DOCUMENTS

| | | | | |
|---|---|---|---|---|
| 6,079,106 | A | 6/2000 | Vallotton | |
| 6,145,202 | A * | 11/2000 | Onion | B26B 1/046 30/160 |
| 6,378,214 | B1 | 4/2002 | Onion | |
| 6,438,848 | B1 * | 8/2002 | McHenry | B26B 1/048 30/160 |
| 7,107,686 | B2 | 9/2006 | Linn et al. | |
| 7,146,736 | B1 | 12/2006 | Collins | |
| 7,941,927 | B1 | 5/2011 | Demko | |
| 8,938,883 | B2 * | 1/2015 | Gringer | B26B 1/046 30/155 |
| 9,079,320 | B2 * | 7/2015 | Onion | B26B 1/044 |
| 2005/0126014 | A1 | 6/2005 | Yamin et al. | |
| 2005/0132576 | A1 * | 6/2005 | Onion | B26B 1/02 30/158 |
| 2006/0123632 | A1 | 6/2006 | Linn et al. | |
| 2007/0068002 | A1 * | 3/2007 | Onion | B26B 1/04 30/161 |
| 2011/0167647 | A1 | 7/2011 | Gringer et al. | |
| 2014/0115898 | A1 | 5/2014 | Collins et al. | |
| 2014/0150268 | A1 * | 6/2014 | Billado, Jr. | B26B 1/08 30/162 |
| 2014/0208595 | A1 | 7/2014 | Frazer | |
| 2015/0330350 | A1 | 12/2015 | Jiang | |
| 2015/0360350 | A1 | 12/2015 | Jiang | |

FOREIGN PATENT DOCUMENTS

| | | | |
|---|---|---|---|
| CN | 201604158 | U | 10/2010 |
| CN | 204585251 | U | 8/2015 |
| CN | 102615655 | A | 1/2019 |

OTHER PUBLICATIONS

Written Opinion dated Oct. 28, 2015 from corresponding International Application No. PCT/CN2015/071002, 4 pages.
Extended European Search Report dated Sep. 5, 2018 from corresponding European Patent Application No. 15878336.5, 6 pages.

* cited by examiner

POWER-ASSISTED FOLDING KNIFE

CROSS-REFERENCED APPLICATIONS

This application is a continuation application of U.S. patent application Ser. No. 15/544,398, filed on Jul. 18, 2017, which is a US National Stage Application of International Application Serial No. PCT/CN2015/071002, filed on Jan. 19, 2015, all of which are incorporated herein by reference thereto.

BACKGROUND

1. Field of the Disclosure

The disclosure relates to a hand tool, and particularly relates to a power-assisted folding knife.

2. Discussion of the Background Art

A folding knife usually needs two hands to operate so as to be unfolded, and requires relatively large force.

The person skilled in the art endeavors to provide a power-assisted folding knife using an assisting mechanism so as to facilitate unfolding of the folding knife and to allow single hand operation.

SUMMARY

It is an object of the disclosure to provide a power-assisted folding knife using an assisting mechanism, providing assisting power when unfolding a folding knife, so as to facilitate unfolding of the folding knife and to allow single hand operation. The power-assisted folding knife is provided with a locking mechanism, which can lock the blade holder in an unfolded position to ensure safe use of the folding knife.

The disclosure provides a power-assisted folding knife, which includes:

a blade holder;

a blade arranged in the blade holder;

a handle rotatably connected to the blade holder;

a locking mechanism for locking the blade holder in an unfolded position and/or a folded position;

characterized in that, the power-assisted folding knife further includes:

an assisting mechanism connected to the blade holder and the handle, for providing assisting power when unfolding a power-assisted folding knife.

Further, the assisting mechanism comprises steel wire.

Further, the blade holder comprises a first portion and a second portion, the steel wire is arranged between the first portion and the second portion.

Further, the first portion of the blade holder is arranged with a first arc-shaped slot, the axis of the first arc-shaped slot coinciding with a first rotation axis, the first rotation axis referring to a rotation axis of the blade holder and the handle, a first end of the steel wire is provided with a first curved part passing through the first arc-shaped slot and embedded in an aperture of the handle.

Further, one side of the second portion of the blade holder, which facing toward the blade, is arranged with a slot, a second end of the steel wire is provided with a second curved part embedded in the slot.

Further, during the unfolding process of the power-assisted folding knife, the torque produced by the elastic force of the steel wire enables the blade holder and the handle to rotate in a direction of unfolding after the second end of the steel wire passes over the extension line of the connection line of the first end and the first rotation axis, so as to provide assisting power for unfolding the power-assisted folding knife.

Further, during the folding process of the power-assisted folding knife, the torque produced by the elastic force of the steel wire enabling the blade holder and the handle to rotate in a direction of folding after the second end of the steel wire passes over the extension line of the connection line of the first end and the first rotation axis, so as to realize the self-lock of the power-assisted folding knife.

Further, the first portion and the second portion of the blade holder are integrated.

Further, the locking mechanism is a side lock or a back lock.

Further, the blade-mounting portion of the blade holder is integrated.

Further, the blade holder is arranged with a blade-pushing pin.

Further, the assisting mechanism comprises a tension spring or a pressure spring.

Further, the tension spring or the pressure spring is arranged in the handle.

Further, a first end of the tension spring or the pressure spring is arranged with a first hinge pin, a second end of the tension spring or the pressure spring is arranged with a second hinge pin.

Further, the handle is arranged with a second arc-shaped slot, the axis of the second arc-shaped slot coinciding with a first rotation axis, the first rotation axis referring to a rotation axis of the blade holder and the handle, the first hinge pin of the tension spring passing through the second arc-shaped slot and embedded in an aperture of the blade holder.

Further, the arc-shaped opening of the second arc-shaped slot turns away from the back of the blade of the power-assisted folding knife.

Further, the handle is arranged with a third arc-shaped slot, the axis of the third arc-shaped slot coinciding with a first rotation axis, the first rotation axis referring to a rotation axis of the blade holder and the handle, the first hinge pin of the pressure spring passing through the third arc-shaped slot and embedded in an aperture of the blade holder.

Further, the arc-shaped opening of the third arc-shaped slot turns toward the back of the blade of the power-assisted folding knife.

Further, the second hinge pin of the tension spring or the pressure spring is embedded in an aperture of the handle.

Further, the tension spring or the pressure spring is arranged in the blade holder.

Further, the locking mechanism is a side lock or a back lock.

Further, the assisting mechanism comprises a torsion spring.

Further, the handle and the blade holder forms a rotatory connection by means of a third hinge pin, the torsion spring is sheathed on the third hinge pin.

Further, the torsion spring is arranged in an aperture of the handle.

Further, a first end of the torsion spring is embedded in a slot of the handle along the radial direction of the torsion spring.

Further, a second end of the torsion spring is embedded in an aperture of the blade holder along the direction parallel to the axial direction of the torsion spring.

Further, the torsion spring is arranged in an aperture of the blade holder.

Further, a first end of the torsion spring is embedded in an aperture of the handle along the direction parallel to the axial direction of the torsion spring.

Further, a second end of the torsion spring is fixed in an aperture of the blade holder.

Further, the locking mechanism comprises a push button, a spring and a push rod.

Further, the spring and the push rod are arranged in a slot of the handle.

Further, one end of the spring is sheathed on the push rod.

Further, the end of the blade holder connecting the handle is arranged with a protruding rim, the protruding rim comprising a first recess part and a second recess part.

Further, the push rod cooperates with the first recess part, locking the blade holder in the folded position.

Further, the push rod cooperates with the second recess part, locking the blade holder in the unfolded position.

Further, the push button moves in a direction distal from the third hinge pin, enabling the push rod to retreat from the second recess part.

The power-assisted folding knife provided by the disclosure has the following advantageous effects:

(1) Applying assisting mechanism to provide assisting power when unfolding the folding knife, to facilitate unfolding of the folding knife, and to enable single hand operation;

(2) Being able to lock the blade holder in the unfolded position and/or the folded position, to ensure safe use of the folding knife.

BRIEF DESCRIPTION OF THE DRAWINGS

FIG. 16 is a rear sectional view of the power-assisted folding knife shown in

FIG. 14;

DETAILED DESCRIPTION OF THE PREFERRED EMBODIMENTS

Figure 1:
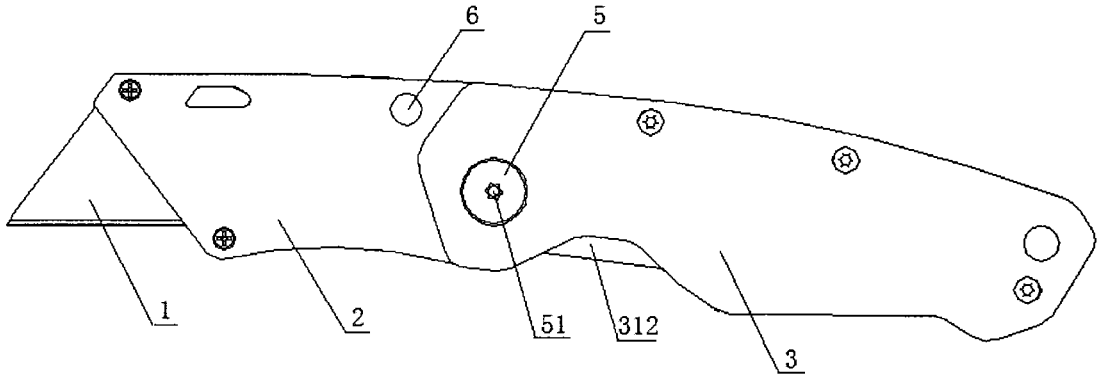
FIG. 1 is a front view of a power-assisted folding knife in an embodiment of the disclosure.
Figure 2:
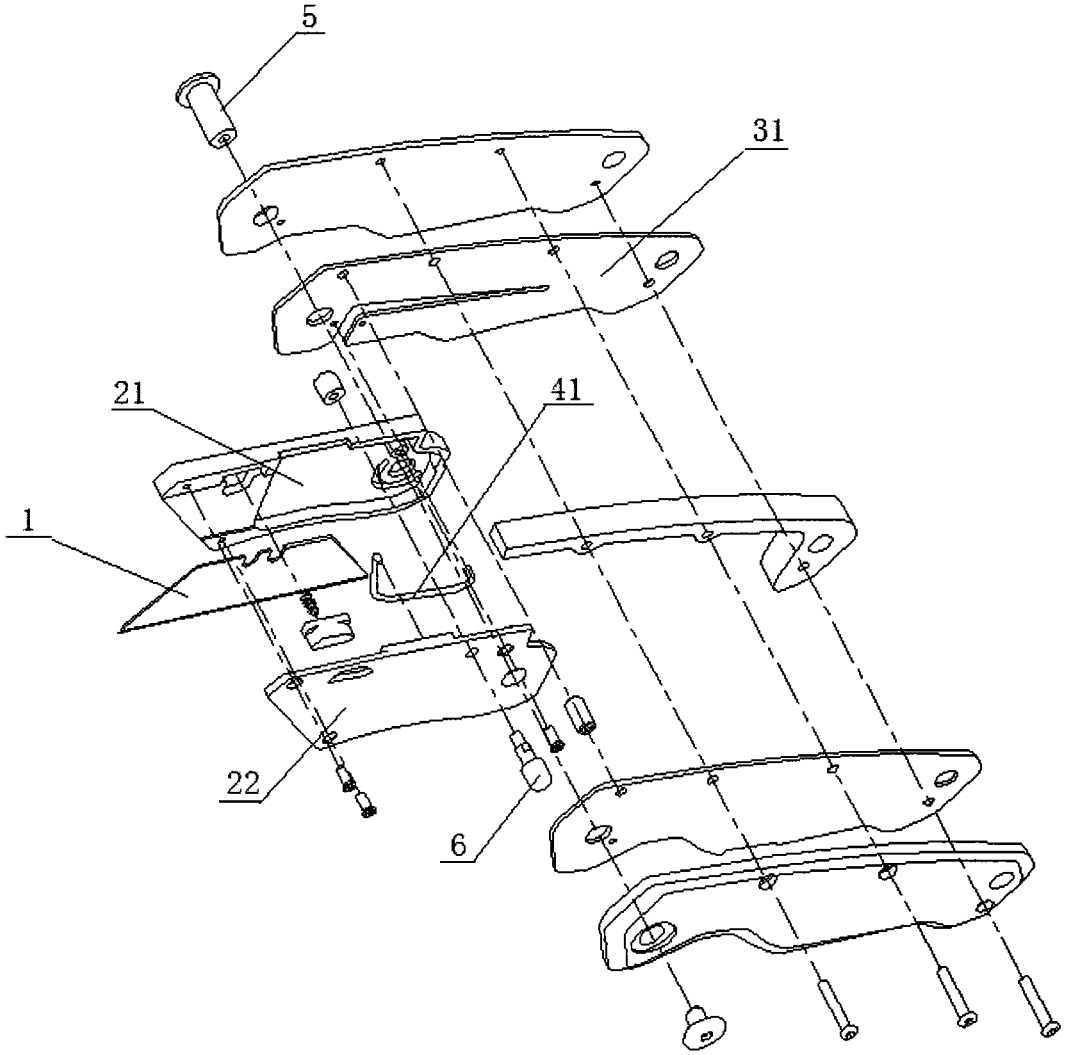
FIG. 2 is an exploded view of the power-assisted folding knife shown in FIG. 1.
Figure 3:
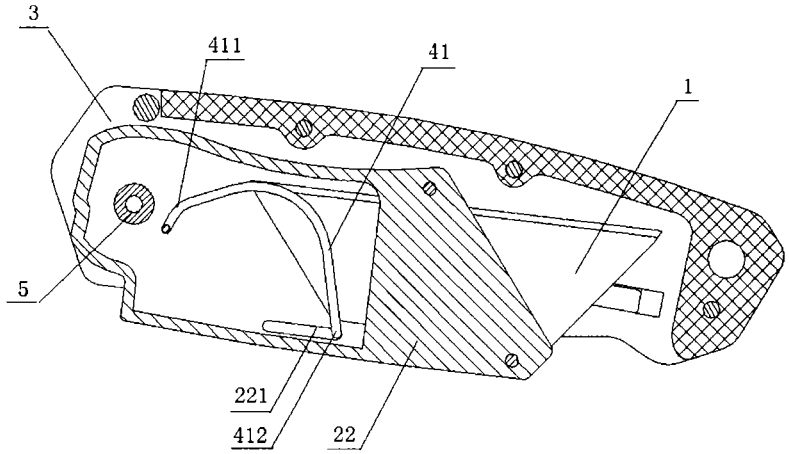
FIG. 3 is a sectional view of the power-assisted folding knife shown in FIG. 1 in a folded state.
Figure 4:
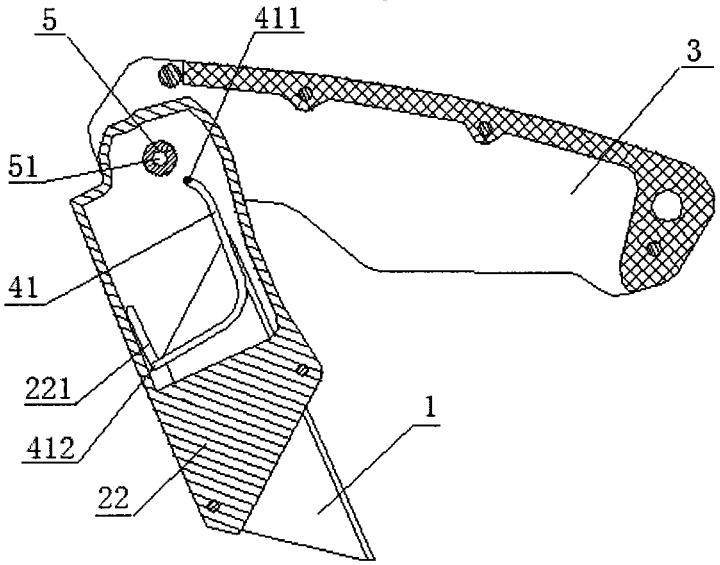
FIG. 4 is a sectional view of the power-assisted folding knife shown in FIG. 1 in an unfolding or folding process.
Figure 5:
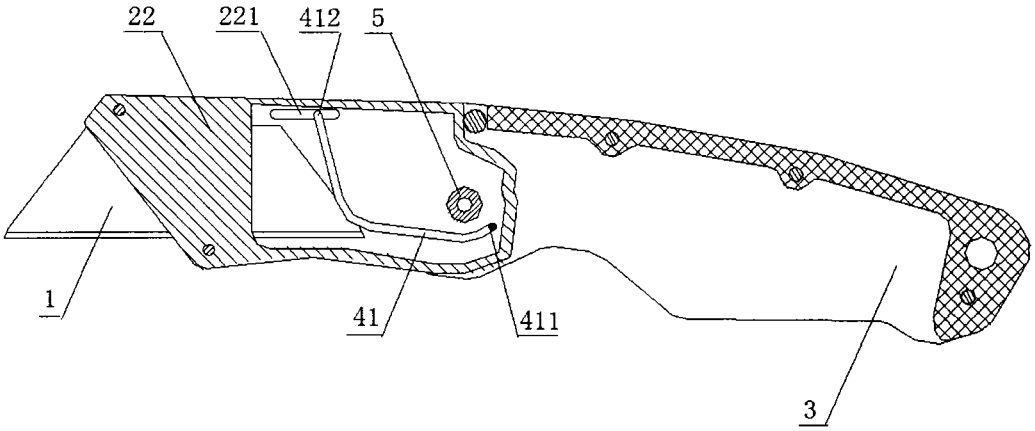
FIG. 5 is a sectional view of the power-assisted folding knife shown in FIG. 1 in an unfolded state.

Now the conception, detailed structure and the technical effect produced thereby of the disclosure will be further described in combination with the accompanying figures, so as to fully understand the object, features and effects of the disclosure.

As shown in FIGS. 1-9, a power-assisted folding knife in an embodiment of the disclosure includes:

a blade holder 2;

a blade 1 arranged in the blade holder 2;

a handle 3 rotatably connected to the blade holder 2;

a locking mechanism for locking the blade holder 2 in an unfolded position and/or a folded position;

the power-assisted folding knife further includes:

an assisting mechanism connected to the blade holder 2 and the handle 3, for providing assisting power when unfolding a power-assisted folding knife.

The power-assisted folding knife in this embodiment uses an assisting mechanism providing assisting power when unfolding a folding knife, so as to facilitate unfolding of the folding knife and to allow single hand operation. The power-assisted folding knife is provided with a locking mechanism, which can lock the blade holder in an unfolded position and/or a folded position to ensure safe use of the power-assisted folding knife.

In this embodiment, the blade holder 2 includes a first portion 21 and a second portion 22 that are oppositely arranged, and the blade 1 is arranged between the first portion 21 and the second portion 22.

The first portion 21 and the second portion 22 of the blade holder 2 may also be integrated or the portion of the blade holder 2 for mounting the blade may be integrated.

In this embodiment, the locking mechanism is a side lock 312, as shown in FIG. 1, 6. The side lock 312 is an elastic leaf with one end connected to the handle 31. When the power-assisted folding knife is being unfolded, the side lock 312 pops up toward the inside of the handle 31. The other end of the side lock 312 prevents the blade holder 2 from rotating toward the handle 3, locking the blade holder 2 in the unfolded position. The inside of the handle 31 refers to the side of the handle 31 facing toward the blade holder 2.

When folding the power-assisted folding knife, pressing the side lock 312 toward the outside of the handle 31, the blade holder 2 then can rotate toward the handle 3.

The locking mechanism may also use other means of locking such as back lock etc. There are many prior arts regarding the structure for locking a blade holder, and we are not going into details herein.

The assisting mechanism includes an elastic member.

In this embodiment, the elastic member is steel wire which is arranged between the first portion 21 and the second portion 22 of the blade holder 2.

Figure 6:
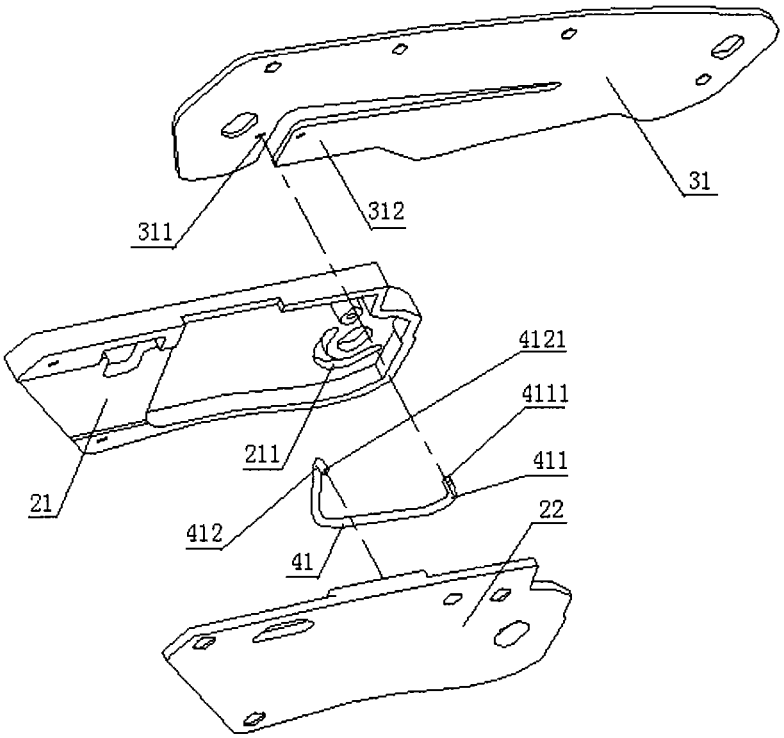
FIG. 6 is a connection relation view of the steel wire of the power-assisted folding knife shown in FIG. 1.

As shown in FIG. 6, the first portion 21 of the blade holder 2 is arranged with a first arc-shaped slot 211. The axis of the arc-shaped slot 211 coincides with the rotation axis of the handle 3 and the blade holder 2. As shown in FIG. 1, the handle 3 and the blade holder 2 forms a rotary connection by means of a hinge pin 5, and the rotation axis of the handle 3 and the blade holder 2 is the axis 51 of the hinge pin 5.

Figure 7:
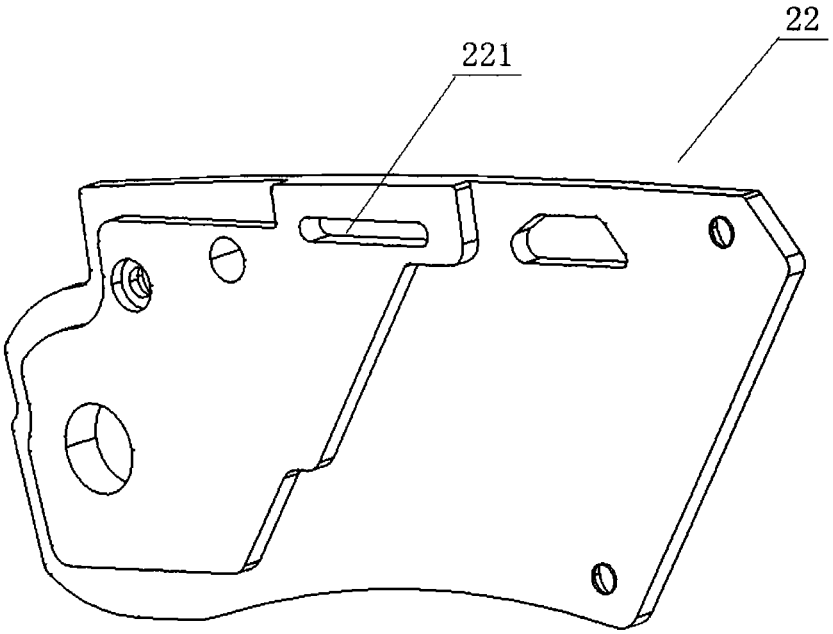
FIG. 7 is a perspective view of a second portion of the blade holder of the power-assisted folding knife shown in FIG. 1.

As shown in FIG. 7, a slot 221 is arranged on the side facing toward the blade, of the second portion 22 of the blade holder 2.

As shown in FIGS. 6, 7, the elastic member is steel wire 41, the first end 411 of which is provided with a first curved part 4111 passing through the first arc-shaped slot 211 of the first portion 21 and embedded in an aperture 311 of the handle 31; the second end 412 of the steel wire 41 is provided with a second curved part 4121 embedded in the slot 221 of the second portion 22.

The power-assisted folding knife in this embodiment realizes the power-assisting function relying on the elastic force provided by steel wire 41, and the steel wire 41 is arranged in the blade holder 2 with one end fixed in the aperture 311 of the handle 31 and the other one end can move freely along the slot 221 on the second portion 22 of the blade holder 2.

Figure 8:
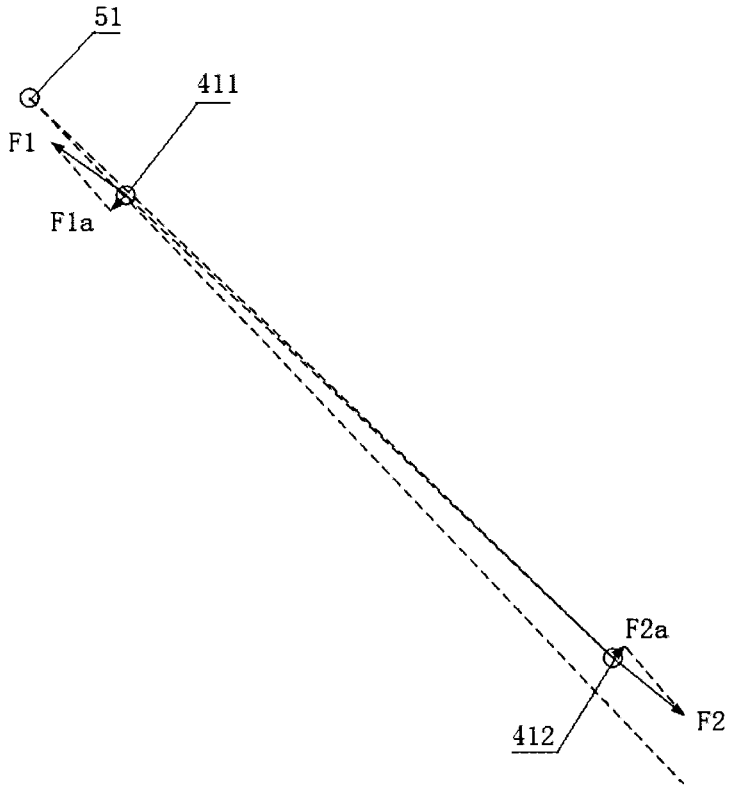
FIG. 8 is a force analysis diagram of the power-assisted folding knife shown in FIG. 1 providing a locking torque when folding.

As shown in FIG. 8, when the power-assisted folding knife in this embodiment is being folded, the second end 412 of the steel wire 41 passes over the extension line of the connection line of the axis 51 of the hinge pin 5 and the first end 411 of the steel wire 41, and the elastic force produced by the steel wire 41 is F1 at the first end 411, and F2 at the second end 412, where F1 and F2 are on the connection line of the first end 411 and the second end 412 in opposite directions.

The component of F1 in the tangential direction is F1*a*, which acts on the handle 3 through the first curved part 4111, producing a torque enabling the handle 3 to rotate toward the blade holder 2, in the clockwise direction as shown in FIG. 8;

The component of F2 in the tangential direction is F2*a*, which acts on the blade holder 2 through the second curved part 4121, producing a torque enabling the blade holder 2 to rotate toward the handle 3, in the counterclockwise direction as shown in FIG. 8;

The torque produced by F1*a* enables the handle 3 to rotate toward the blade holder 2, and the torque produced by F2*a* enables the blade holder 2 to rotate toward the handle 3, that is, the torque produced by the elastic force of the steel wire enables the blade holder 2 and the handle 3 to rotate in a direction of folding, so as to realize self-lock of the power-assisted folding knife.

When the power-assisted folding knife in this embodiment is being unfolded, the blade-pushing pin 6 is pushed to overcome the self-lock force produced by the steel wire, as shown in FIG. 1, providing the torque for rotating out the blade holder 2.

Figure 9:
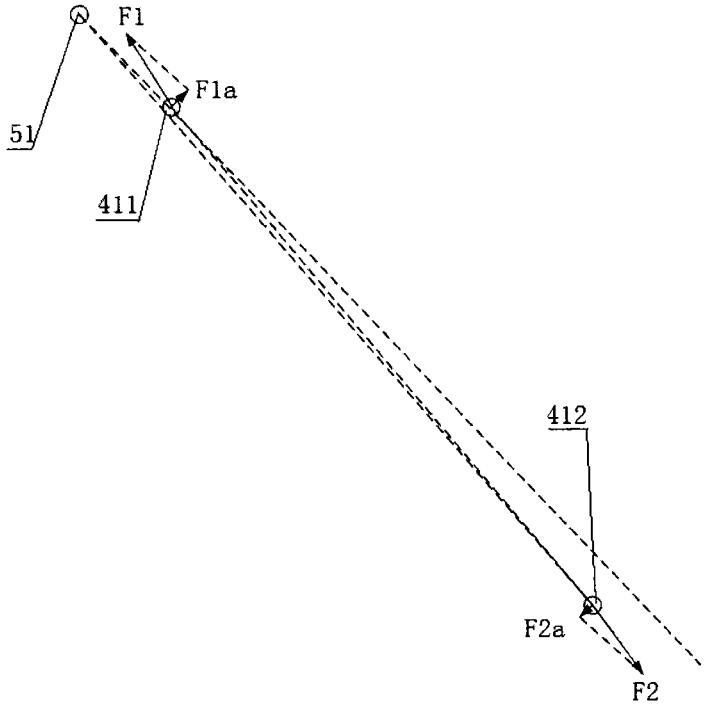
FIG. 9 is a force analysis diagram of the power-assisted folding knife shown in FIG. 1 providing an unfolding torque when unfolding.

As shown in FIG. 9, when the power-assisted folding knife in this embodiment is being unfolded, the second end 412 of the steel wire 41 passes over the extension line of the connection line of the axis 51 of the hinge pin 5 and the first end 411 of the steel wire 41, and F1*a* acts on the handle 3 through the first curved part 4111, where the torque produced enables the handle to rotate in a direction distal from the blade holder 2, in the counterclockwise direction as shown in FIG. 9, and F2*a* acts on the blade holder 2 through the second curved part 4121, where the torque produced enables the blade holder 2 to rotate in a direction distal from the handle 3, in the clockwise direction as shown in FIG. 9, so as to provide assisting power for unfolding the folding knife, that is, the elastic force of the steel wire providing the torque for unfolding the power-assisted folding knife.

Figure 10:
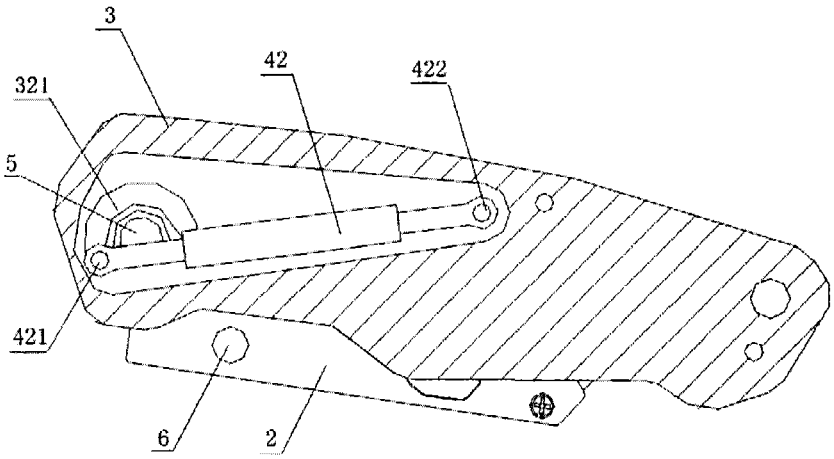
FIG. 10 is a sectional view of a power-assisted folding knife in another embodiment of the disclosure in a folded state.
Figure 11:
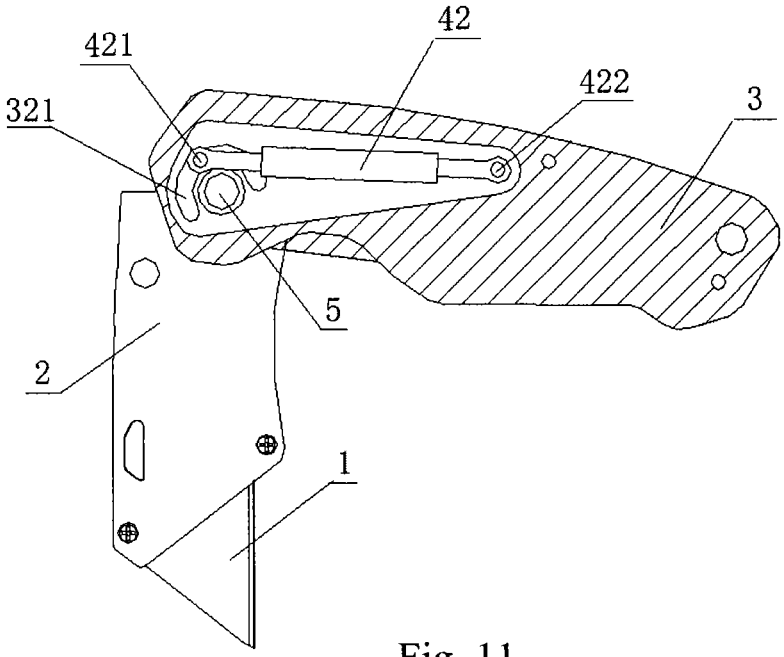
FIG. 11 is a sectional view of the power-assisted folding knife shown in FIG. 10 in an unfolding or folding process.
Figure 12:
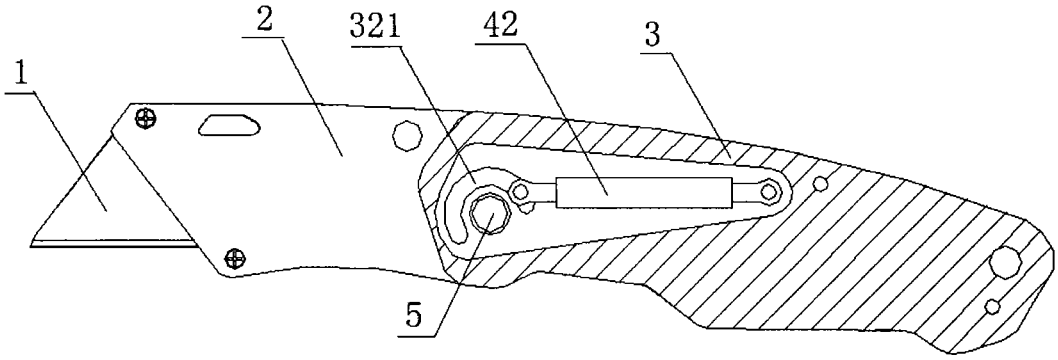
FIG. 12 is a sectional view of the power-assisted folding knife shown in FIG. 10 in an unfolded state.

As shown in FIGS. 10-12, the power-assisted folding knife in another embodiment of the disclosure differs from the embodiment shown in FIG. 1 in that: the elastic member is a tension spring 42; the tension spring 42 is arranged in the handle 3, and may also be arranged in the blade holder.

The handle 3 is arranged with a second arc-shaped slot 321, with the axis of the second arc-shaped slot 321 coinciding with the rotation axis of the handle 3 and the blade holder 2. The handle 3 and the blade holder 2 form a rotatory connection by means of a hinge pin 5, where the rotation axis of the handle 3 and the blade holder 2 is the axis of the hinge pin 5.

The first end 421 of the tension spring 42 is arranged with a first hinge pin passing through the second arc-shaped slot 321 and embedded in the aperture of the blade holder 2.

The second end 422 of the tension spring 42 is arranged with a second hinge pin embedded in the aperture of the handle 3.

As shown in FIG. 10, the power-assisted folding knife is in the folded state, where the first end 421 of the tension spring 42 is in the position distal to the second end 422 in the second arc-shaped slot 321 and the tension spring 42 is in a stretched state, i.e. energy storing state.

Similar to the embodiment as shown in FIG. 1, when the power-assisted folding knife is being folded, the second end 422 passes over the extension line of the connection line of the axis of the hinge pin 5 and the first end 421, and the torque produced by the elastic force of the tension spring 42 enables the blade holder 2 and the handle 3 to rotate in a direction of folding so as to realize self-lock; when the power-assisted folding knife is being unfolded, the second end 422 passes over the extension line of the connection line of the axis of the hinge pin 5 and the first end 421, and the torque produced by the elastic force of the tension spring 42 enables the blade 2 and the handle 3 to rotate in a direction of unfolding so as to provide assisting power for unfolding the power-assisted folding knife.

In this embodiment, the locking mechanism uses a side lock, and may also use a back lock, for locking the blade holder 2 in the unfolded position; as shown in FIG. 10, the blade holder 2 is arranged with a blade-pushing pin 6 for providing torque for unfolding the power-assisted folding knife.

Figure 13:
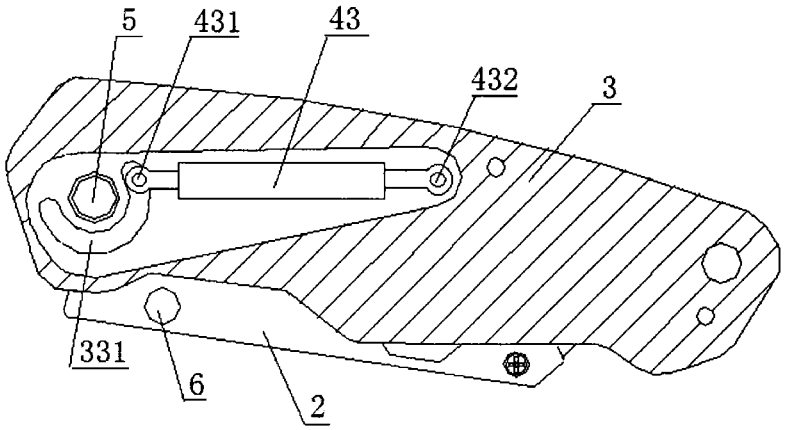
FIG. 13 is a sectional view of a power-assisted folding knife in a further embodiment of the disclosure in a folded state.

As shown in FIG. 13, a power-assisted folding knife in a further embodiment of the disclosure differs from the power-assisted folding knife as shown in FIGS. 10-12 in that: the elastic member is a pressure spring 43, the direction of the third arc-shaped slot 331 is different from the direction of the second arc-shaped slot 321, the arc-shaped opening of the third arc-shaped slot 331 turning toward the back of the blade.

When the power-assisted folding knife is being folded, the second end 432 passes over the extension line of the connection line of the axis of the hinge pin 5 and the first end 431, and the torque produced by the elastic force of the pressure spring 43 enables and the blade holder 2 and the handle 3 to rotate in a direction of folding, so as to realize self-lock; when the power-assisted folding knife is being unfolded, the second end 432 passes over the extension line of the connection line of the axis of the hinge pin 5 and the first end 431, and the torque produced by the elastic force of the pressure spring 43 enables the blade holder 2 and the handle 3 to rotate in a direction of unfolding, so as to provide assisting power for unfolding the power-assisted folding knife.

When the power-assisted folding knife is in the folded state, the first end 431 of the pressure spring 43 is in a position proximal to the second end 432 of the pressure spring 43 in the third arc-shaped slot 331, and the pressure spring 43 is in the compressed state, i.e. energy storing state; when the power-assisted folding knife is being unfolded, the elastic force of the pressure spring 43 provides assisting power.

The pressure spring 43 may also be arranged in the blade holder.

A power-assisted folding knife in a further embodiment of the disclosure, as shown in FIGS. 14-18, differs from the embodiment shown in FIG. 1 in that: the elastic member is a torsion spring 44 arranged in the aperture of the handle 3.

Figure 15:
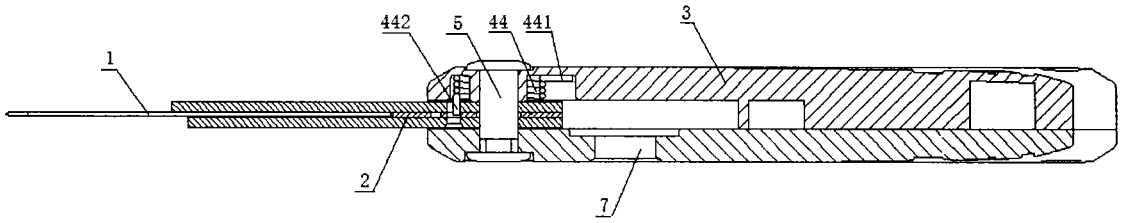
FIG. 15 is a top sectional view of the power-assisted folding knife shown in FIG. 14.
Figure 16:
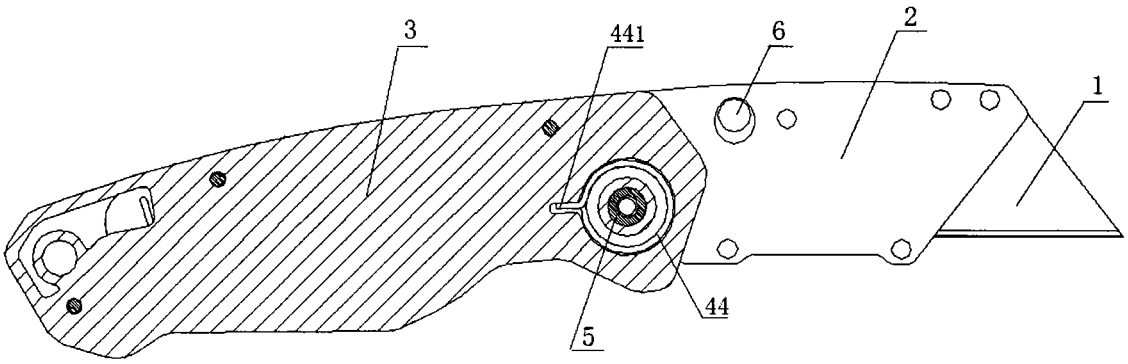

The handle 3 and the blade holder 2 forms a rotatory connection, and the torsion spring 44 is provided around the hinge pin 5, as shown in FIGS. 15, 16. The first end 441 of the torsion spring 44 is embedded in the slot of the handle 3 along the radial direction of the torsion spring 44; the second end 442 of the torsion spring 44 is embedded in the aperture of the blade holder 2 along the direction parallel with the axial direction of the torsion spring 44.

When folding the power-assisted folding knife in this embodiment, applying force to the torsion spring 44 to enable the torsion spring 44 to be in energy storing state; when unfolding the power-assisted folding knife, the elastic force of the torsion spring 44 provides assisting power.

The power-assisted folding knife in this embodiment also includes a locking mechanism including a push button 7, spring 71 and push rod 72. One end of the spring 71 is provided around the push rod 72, and the spring 71 and the push rod 72 are arranged in the slot of the handle 3, as shown in FIGS. 17, 18, the push button 7 is connected with the push rod 72.

The end of the blade holder 2, which is connected to the handle 3, is arranged with a protruding rim including a first recess part 23 and the second recess part 24.

Figure 17:
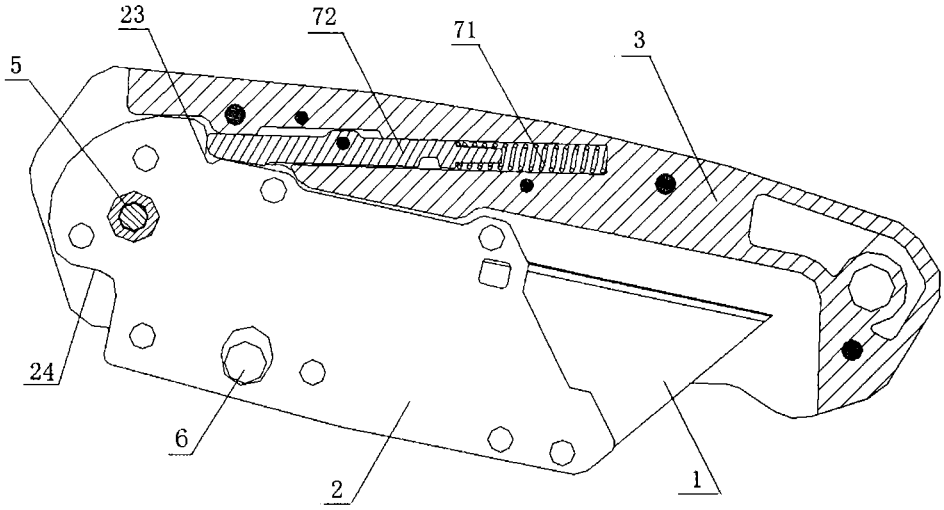
FIG. 17 is a sectional view of the power-assisted folding knife shown in FIG. 14 with the locking mechanism locking the folded position.

When the power-assisted folding knife is in the folded position, the push rod 72 cooperates with the first recess part 23, locking the blade holder 2 in the folded position, as shown in FIG. 17; when needing to unfold the power-assisted folding knife, pushing the blade-pushing pin 6, and under the torque provided by the blade-pushing pin 6, the push rod 72 slides out from the first recess 23 and then the power-assisted folding knife can be unfolded.

Figure 18:
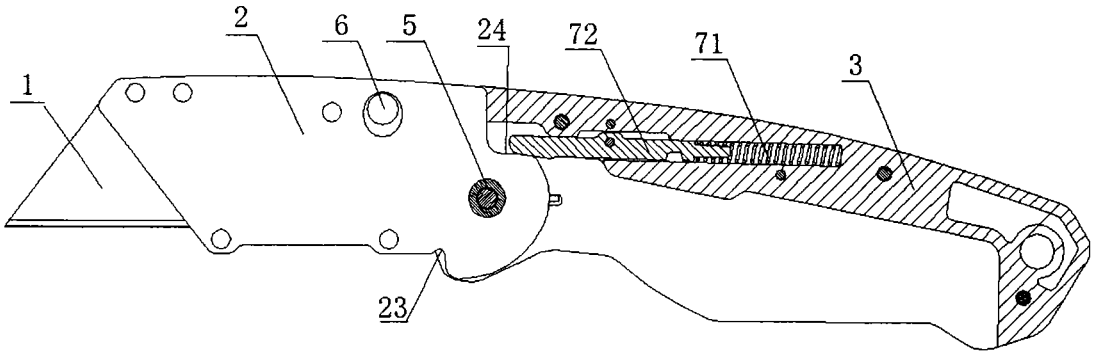
FIG. 18 is a sectional view of the power-assisted folding knife shown in FIG. 14 with the locking mechanism locking the unfolded position.

When the power-assisted folding knife is in the unfolded position, the push rod 72 cooperates with the second recess 24, locking the blade holder 2 in the unfolded position, as shown in FIG. 18; when needing to fold the power-assisted folding knife, pushing the push button 7 toward the spring 71, enabling the push rod 72 to retreat from the second recess 24, then the power-assisted folding knife can be folded.

Figure 14:
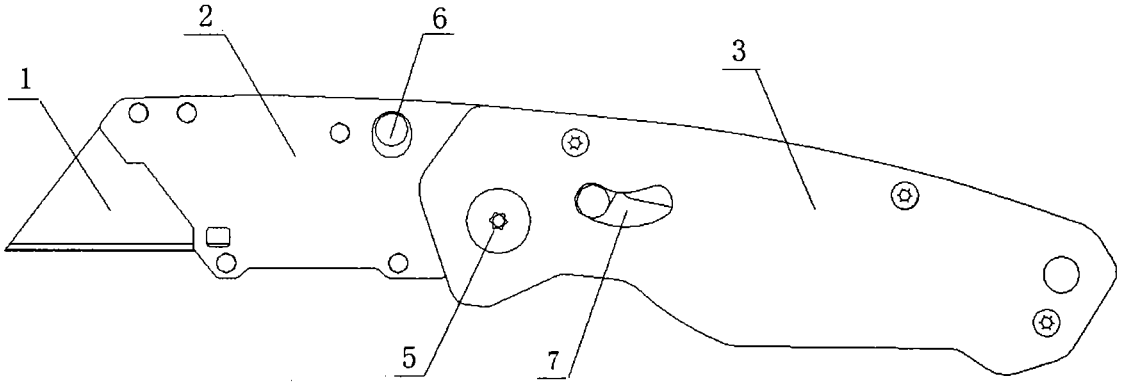
FIG. 14 is a front view of the power-assisted folding knife in a further embodiment of the disclosure.
Figure 19:
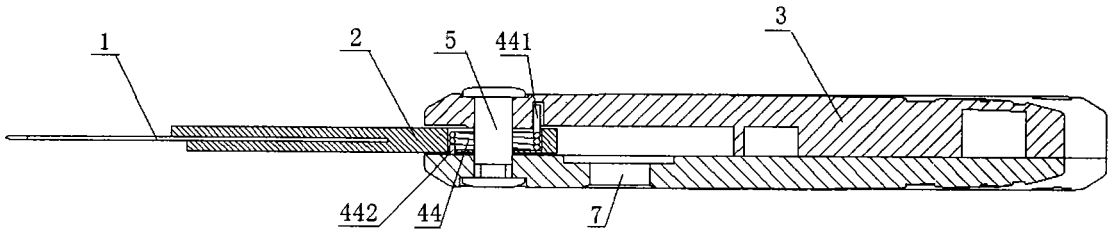
FIG. 19 is a sectional view of a power-assisted folding knife in a further embodiment of the disclosure in a folded state.

As shown in FIG. 19, a power-assisted folding knife in a further embodiment of the disclosure differs from the embodiment shown in FIG. 14 in that: the torsion spring 44 is arranged in the aperture of the blade holder 2.

The first end 441 of the torsion spring 44 is embedded in the aperture of the handle 3 along the direction parallel to the axial direction of the torsion spring 44.

The second end 442 of the torsion spring 44 is fixed in the aperture of the blade holder 2.

The disclosure provides a power-assisted folding knife using assisting mechanism, providing assisting power when unfolding the power-assisted folding knife, to facilitate unfolding of the folding knife and to allow single hand operation; the blade holder can be locked in an unfolded position and/or a folded position to ensure safe use of the power-assisted folding knife.

Various assisting mechanisms of the disclosure that are arranged in the handle may also be arranged in the blade holder.

The foregoing described the preferred embodiments of the present disclosure. It should be understood that an ordinary person skilled in the art can make many modifications and variations according to the concept of the present disclosure without creative work. Therefore, any technical solution obtained by a person skilled in the art according to the concept of the present disclosure through logical analyses, deductions and limited experiments should fall into the protection scope defined by the claims.

What is claimed is:

1. A power-assisted folding knife, wherein the power-assisted folding knife comprises:

a blade;

a power-assisted folding device, comprising:

a handle;

a carrying member used as a blade holder;

wherein the blade is arranged in the blade holder and the blade holder is rotatably connected to the handle about a rotation axis;

wherein the blade holder rotates relative to the handle around the rotation axis in a direction of folding when folding the power-assisted folding knife, and the blade holder rotates relative to the handle around the rotation axis in a direction of opening when unfolding the power-assisted folding knife;

an assisting mechanism connected to the blade holder and the handle;

wherein in at least a part of a stroke of the unfolding process of the power-assisted folding knife, the assisting mechanism generates a torque along the direction of opening relative to the rotation axis;

wherein the assisting mechanism comprises a first end and a second end, the first end being rotatably connected to the handle, and the second end being movably coupled to the blade holder, and during the process of folding or opening the power-assisted folding knife, the second end of the assisting mechanism passes over an extension line of a connection line between the first end and an axis of the handle only once;

wherein in at least a part of the stroke of the folding process of the power-assisted folding knife, the assisting mechanism generates a torque along the direction of folding relative to the rotation axis;

wherein there is a critical position during the process of folding or unfolding the power-assisted folding knife, and after the assisting mechanism passes over the critical position, the direction of the torque generated by the assisting mechanism relative to the rotation axis changes once between the direction of folding and the direction of opening;

wherein during the process of unfolding the power-assisted folding knife, after the second end passes over the critical position, the assisting mechanism generates the torque along the direction of opening relative to the rotation axis to provide assisting power for unfolding the power-assisted folding knife: during the process of folding the power-assisted folding knife, after the second end passes over the critical position, the assisting mechanism generates the torque along the direction of folding relative to the rotation axis to realize self-lock of the power-assisted folding knife;

wherein the assisting mechanism comprises an elastic member, the elastic member is a steel wire;

wherein the blade holder comprises a first portion and a second portion that are oppositely disposed, and the steel wire is arranged between the first portion and the second portion;

the first portion of the blade holder is arranged with a first arc-shaped slot, an axis of the first arc-shaped slot coinciding with the rotation axis; and a first end of the steel wire is provided with a first curved part passing through the first arc-shaped slot and embedded in an aperture of the handle;

one side of the second portion of the blade holder, which faces toward the blade, is arranged with a slot, and a second end of the steel wire is provided with a second curved part embedded in the slot;

the second end of the steel wire is in the critical position when the second curved part of the steel wire moves to an extension line of a connection line of the first curved part and the rotation axis.

2. The power-assisted folding knife according to claim 1, wherein the first portion and the second portion of the blade holder are integrated.

3. The power-assisted folding knife according to claim 1, wherein the power-assisted folding knife further comprises a locking mechanism for locking the blade holder in an unfolded position and/or a folded position; wherein the locking mechanism is a side lock or a back lock.

4. The power-assisted folding knife according to claim 1, wherein the blade holder is arranged with a blade-pushing pin; when unfolding the power-assisted folding knife, pushing the blade-pushing pin to overcome the torque along the direction of opening generated by the assisting mechanism.

5. The power-assisted folding knife according to claim 1, wherein the blade is replaceably mounted in the blade holder.

6. The power-assisted folding knife according to claim 5, wherein the blade is a trapezoidal blade.

7. The power-assisted folding knife according to claim 5, wherein a portion of the blade holder where the blade is mounted is made as a whole.

* * * * *